United States Patent [19]

Bonnet et al.

[11] Patent Number: 4,983,799

[45] Date of Patent: Jan. 8, 1991

[54] DEVICE FOR SUPPORTING THE CONTROL MEANS FOR A DOMESTIC APPLIANCE

[75] Inventors: Jacques Bonnet, Olivet; Gérard Pressouyre, Le Chateau D'Olonne, both of France

[73] Assignee: Compagnie Europeenne pour l'Equipement Menager-Cepem, St. Jean-de-la-Ruelle, France

[21] Appl. No.: 451,875

[22] Filed: Dec. 18, 1989

[30] Foreign Application Priority Data

Dec. 27, 1988 [FR] France ..... 88 17219

[51] Int. Cl.[5] ..... H05B 6/12

[52] U.S. Cl. ..... 219/10.493; 219/10.67; 219/10.75; 219/444; 219/460; 126/21 A; 126/299 D

[58] Field of Search ..... 219/10.493, 10.75, 10.67, 219/444, 460, 463, 506; 126/299 D, 21 A, 21 R; 312/236

[56] References Cited

U.S. PATENT DOCUMENTS

| | | | |
|---|---|---|---|
| 3,877,457 | 4/1975 | Doner | 219/460 |
| 3,890,887 | 6/1975 | Kaufman et al. | 126/299 D |
| 4,143,646 | 3/1979 | Sampsel | 126/229 D |
| 4,415,788 | 11/1983 | Field | 219/10.493 |
| 4,549,052 | 10/1985 | Simon | 219/10.493 |
| 4,551,600 | 11/1985 | Miyagawa et al. | 219/460 X |

FOREIGN PATENT DOCUMENTS

| | | |
|---|---|---|
| 2364667 | 6/1975 | Fed. Rep. of Germany . |
| 2658099 | 7/1978 | Fed. Rep. of Germany . |
| 8130645 | 3/1986 | Fed. Rep. of Germany . |
| 2340513 | 9/1977 | France . |

*Primary Examiner*—Philip H. Leung

*Attorney, Agent, or Firm*—Oblon, Spivak, McClelland, Maier & Neustadt

[57] ABSTRACT

A cook hob (1) possesses a device for the support of controls (10) which are mounted pivotably on a housing (7) equipped with a ventilation circuit. The device comprises a body (12) having a channel (13), one end of which forms the outlet port of the ventilation circuit. The body (12) can pivot between a position in which the controls (10) are accessible and the outlet port is open, and a position in which the controls are not accessible and the outlet port is closed.

6 Claims, 2 Drawing Sheets

DEVICE FOR SUPPORTING THE CONTROL MEANS FOR A DOMESTIC APPLIANCE

BACKGROUND OF THE INVENTION

The invention relates to a device for supporting the control means for a domestic appliance, which, being movable, makes it possible to change the aesthetic appearance of the appliance depending on whether it is in operation or not, and to ensure correct ventilation for cooling it during operation.

DESCRIPTION OF THE PRIOR ART

Where induction-type cooking hobs are concerned, the power electronics have to be cooled, and for this purpose it is known to arrange them in a ventilation circuit which extends under the cooking hob from the rear of the appliance (ventilation space) towards the front, where ports are provided for the hot-air outlet. Some of these hobs are incorporated in a cabinet, and the ventilating circulation takes plate in this. Others are of the type called flush-mountable in a separate support, and the ventilation conduit will be provided more or less effectively by the installed, especially as regards the discharge of the hot air.

SUMMARY OF THE INVENTION

The invention makes it possible, in all cases, to maintain a correct construction of the ventilation circuit, particularly where flush-mountable appliances are concerned, by means of a special mounting and form of the supporting strip for the control means (knobs, buttons, etc.) of the appliance. This mounting makes it possible, furthermore, to change the aesthetic appearance of the appliance by masking these means when the appliance is not in operation.

For this purpose, the invention provides a device for supporting the control means for an appliance enclosed at least partially in a housing equipped with an internal ventilation circuit having an outlet port in the vicinity of the control mean, this device comprising a body mounted on the housing and having a face on which the control means are arranged, this body being movable between a first position in which the control means are accessible and a second position in which they are not and forming a member for opening the outlet port in its first position and a member for closing the outlet port in its second position According to one characteristic of the invention, the body possesses a passage having a first end exiting into the housing and a second end opening out in the vicinity of the face where the control means are arranged and exiting on the outside when the body is in the first position, this second end constituting the outlet port.

BRIEF DESCRIPTION OF THE DRAWINGS

Other characteristics and advantages of the invention will emerge from a reading of the following description of three embodiments of the invention given by way of example and without any limiting intention. Reference will be made to the accompanying drawings in which:

FIG. 1 illustrates an induction-heating cooking hob 1 flush-mounted in a piece of furniture 2 having a ventilation space 3 in its rear part. The cooking hob 1 comprises a deck 4 supporting several heating plates 5 connected in a way known per se to an electronic power system composed of circuit boards 6 extending under the plates 5. The assembly as a whole is enclosed in a housing 7 of which the deck 4 forms the upper wall.

Figure 1:
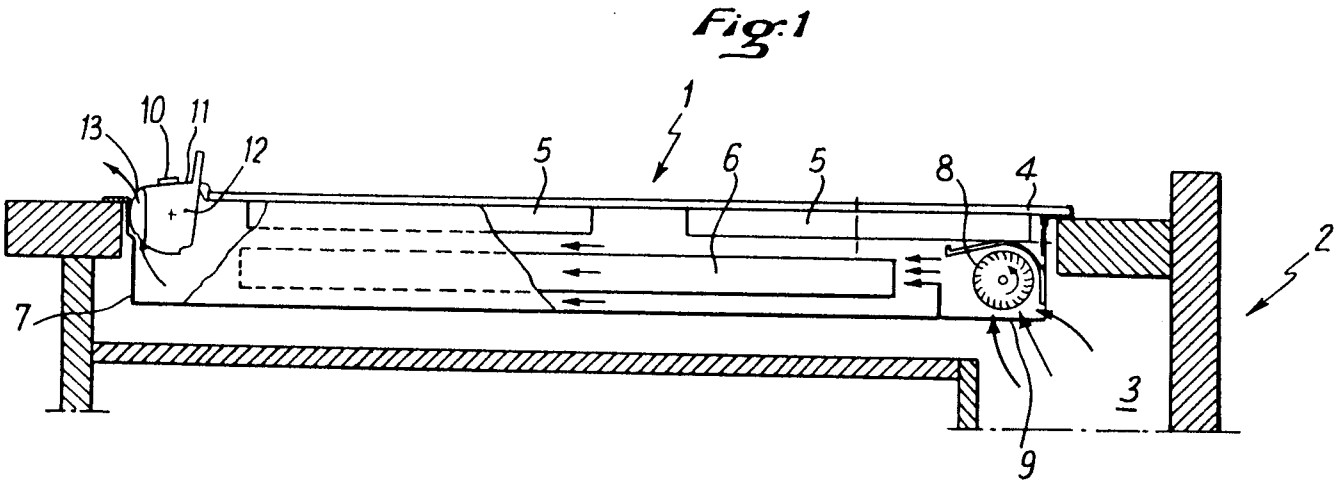
FIG. 1 is a diagrammatic side view, partially in section, of a cooking hob flush-mounted in a supporting piece of furniture, during operation.

The cooking hob 1 also possesses a ventilation circuit for cooling the electronic system. This circuit includes a ventilator 8 mounted in the vicinity of the rear wall of the housing 7 and shaped so as to force air in a direction substantially parallel to the electronic circuit boards 6. In the region of the ventilator 8, the bottom of the housing 7 has a port 9 which is consequently arranged vertically in line with the ventilation space 3 and through which the air forced into the housing 7 is removed by suction.

Arranged at the front of the cooking hob 1 between the front edge of the deck 4 and the front wall of the housing 7 are the control means 10 (knobs, buttons, or the like) which make it possible to adjust the heating intensity of the plates 5. The control means are supported by the device according to the invention, which comprises a control strip 11 composed of one face of an elongate body 12 mounted on the housing 7 so as to be pivotable through approximately 90° about its longitudinal axis between a position in which the strip 11 is completely visible (FIG. 1) and a position in which it is invisible (FIG. 2). Advantageously, the body 12 is returned respectively into both of these positions by elastic means (not shown). The body 12 possesses cells, where the control means are partially embedded, and the connections of these control means to the cables connecting them to the electronic system.

The body 12 also possesses a clearance 13, the bottom of which extends substantially perpendicularly relative to the front edge of the control strip 11. This clearance delimits a passage of which a first end always exits on the inside of the housing 7 and of which the second end exits either outside the housing 7, when the body 12 is tilted into the position illustrated in FIG. 1, or inside the housing, when the body 12 is tilted into the position illustrated in FIG. 2. This second end constitutes the outlet port of the ventilation circuit, which is therefore open or closed, depending on whether the body is tilted into one of its two positions or the other.

By means of this arrangement, putting the cooking hob 1 into operation, which can take place only if the control means 10 are accessible, necessarily causes the opening of the outlet port, allowing the air forced by the ventilator 8 to escape, that is to say also allowing the indispensable flow of ventilation air round the electronic power system.

To avoid the adverse consequences which would arise if, with the cooking hob in operation, the body 12 were tilted into the position illustrated in FIG. 2, provision is made for associating this position with the opening of a breaker arranged on the supply circuit of the cooking hob.

Figure 3:
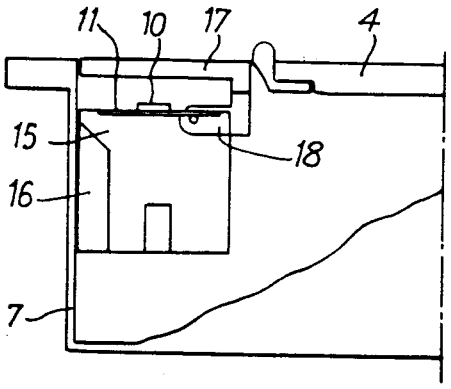
FIGS. 3 and 4 are partial diagrammatic side views of a second device for supporting the control means of a cooking hob, out of operation (FIG. 3) and during operation (FIG. 4)
Figure 4:
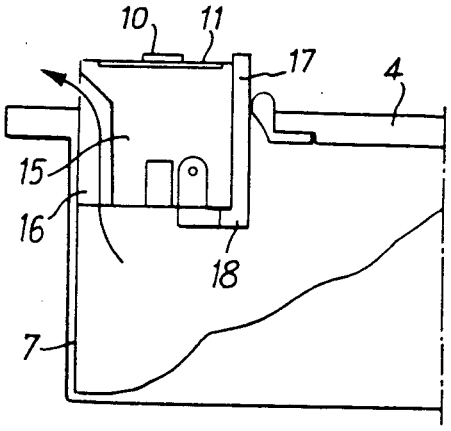

FIGS. 3 and 4 illustrate a second embodiment of the supporting device according to the invention. This device comprises an elongate body 15 of rectangular cross-section, having an upper face forming the control strip 11. The body 15 is guided in translational motion against the front wall of the housing 7 in a direction perpendicular to the deck 4. The body 15 is movable between a position, in which the control strip 11 is inset in relation to the deck 4 (FIG. 3), and a position, in which the control strip projects relative to the deck (FIG. 4). It possesses a clearance 16 opening onto its lower face and onto its face adjacent to the housing 7, so that, when it is in the position projecting relative to the deck 4, one of end of this clearance exits to the outside and constitutes the outlet port of the ventilation circuit. The body 15 is subjected to the action of an elastic member (not shown) which tends to return it to this position. A flat lid 17 is mounted pivotably on the housing 7 by means of lateral L-shaped lugs 18 having a segment parallel to the lid, the pivot axis being parallel to the upper face of the body 15 and passing in the region of the free end of the lugs 18. The closing of this lid causes the body 15 to be set into the housing 7 and locked in the inset position.

Figure 5:
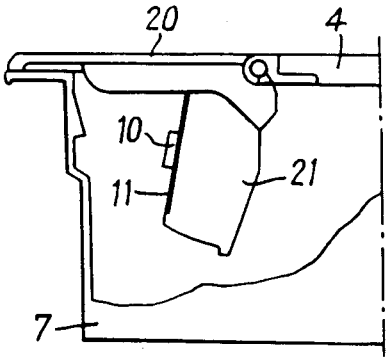
FIGS. 5, 6 and 7 are partial diagrammatic side views of a third device for supporting the control means of a cooking hob, out of operation (FIG. 5) and during operation (FIGS. 6 and 7).
Figure 6:
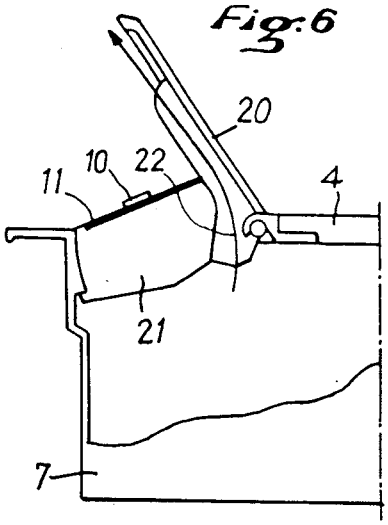
Figure 7:
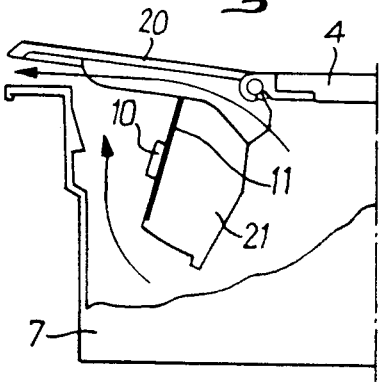

FIGS. 5, 6 and 7 illustrate a third embodiment of the device according to the invention. In this embodiment, a protective screen 20 is integral with an elongate body 21, one face of which forms the control strip 11 of a cooking hob. This screen, which extends along the rear part of the body 21 and is inclined at approximately 90° relative to the control strip 11, is intended for protecting the latter from a flow of liquid attributable to the overturning or overflowing of a saucepan. The body 21 is mounted pivotably on the housing 7 about an axis parallel to the edge of the front wall of the housing 7 and coinciding substantially with the rear edge of the screen 20. The body 21 possesses a passage 22 extending transversely relative to the screen 20 along this screen and exiting on the one hand in the housing 7 and on the other hand in the region of the rear edge of the control strip 11. The body 21 is subjected to the action of an elastic member associated with a set of stops (not shown) tending to return the body 21 and the screen 20 into one of the three positions illustrated in FIGS. 5, 6 and 7. In the first position (cooking hob out of operation), the screen 20 closes the housing 7 and the control strip 11 is not visible. In the second position (cooking hob in operation), the screen 20 is raised as far as it will go, the control strip 11 is visible and the front part of the body 21 is up against the front wall of the housing 7, and the passage 22 thus puts the interior of the housing 7 in communication with the outside. In the third position (cooking hob in operation), the screen 20 occupies an intermediate position, and it is not possible to manipulate the control means; however, the cooking hob can operate, and the ventilation air can escape from the housing 7 along the paths represented by the arrows. This third position ensures maximum protection for the control strip 11, whilst at the same time it prevents the heat setting of the plates from being changed.

Figure 2:
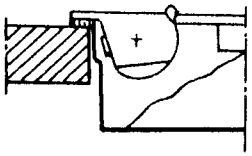
FIG. 2 is a partial diagrammatic side view, in section, of the device for supporting the control means of the hob illustrated in FIG. 1, out of operation.

Like the device illustrated in FIGS. 1 and 2, the devices illustrated respectively in FIGS. 3 and 4 and in FIGS. 5, 6 and 7 can be equipped with a safety member cutting off the supply to the cooking hob when the lid 17 or the screen 20 are turned down into the plane of the deck 4, that is to say when the outlet port of the ventilation circuit is closed.

The device for supporting the control means 10, associated with the cooking hob 1 shown in FIG. 1, operates as follows To use the cooking hob, the body 12 is tilted so as to reveal the control strip 11. The breaker located on the supply circuit of the cooking hob is thus closed. The manipulation of one of the control means 10 causes both the activation of the ventilator 8 and the heating of the corresponding plate 5. The ventilator 8 sucks air into the ventilation space 3 via the suction port 9. The air forced by the ventilator into the housing 7 flows along the electronic circuit boards 6 and then, after being heated and having cooled the said boards, escapes through the outlet formed by the end of the clearance 13 of the body 12 opening onto the outside. If, during operation, the body 12 were unintentionally tilted in the opposite direction, the supply to the cooking hob would be cut off automatically.

The invention is not limited to the embodiments illustrated, and it is capable of having alternative embodiments.

We claim:

1. A heating appliance comprising:

an induction-type cooking hob mounted on a housing;

a movable body mounted on said housing, said body comprising a face on which are arranged control knobs, said body being movable between a first position where the knobs are outside the housing and a second position where the knobs are inside the housing;

power electronics for providing power to said cooking hob;

an internal ventilation circuit within the housing for cooling said power electronics;

said body having an air ventilation passage with a first end exiting into the housing and a second end opening outside the housing in the vicinity of the face, said second end constituting an outlet port for said internal ventilation circuit when the body is in the first position, and said internal ventilation circuit being closed by the body when the body is in the second position.

2. A heating appliance as claimed in claim 1, wherein the body is movable by pivoting about an axis parallel to the face.

3. A heating appliance as claimed in claim 1, wherein the body is movable in translational motion along an axis passing through the housing.

4. A heating appliance as claimed in claim 3, wherein a lid is mounted pivotably on the housing in order to cover the face when the body is in the second position.

5. A hating appliance as claimed in claim 4, further comprising elastic means for returning the body into the first position, the lid serving as a locking means for locking the body in the second position.

6. A heating appliance comprising:

an induction-type cooking hob mounted on a housing;

a movable body carrying control means for adjusting the heating intensity of the cooking hob;

ventilating means for cooling an area within said housing; said ventilating means having an outlet port adjacent to said control means;

said body being mounted so as to be movable to a first position in which said outlet port is open with said control means being located outside said housing; said body also being mounted so as to be movable to a second position in which said outlet port is closed by said body with said control means being located inside said housing.

* * * * *